US011732388B2

(12) United States Patent
Wang

(10) Patent No.: US 11,732,388 B2
(45) Date of Patent: Aug. 22, 2023

(54) COMPOSITE LOW-TWIST YARN TOWEL AND PRODUCTION METHOD THEREOF

(71) Applicant: Loftex Home, LLC, New York, NY (US)

(72) Inventor: Hongxing Wang, Shandong (CN)

(73) Assignee: Loftex Home, LLC, New York, NY (US)

( * ) Notice: Subject to any disclaimer, the term of this patent is extended or adjusted under 35 U.S.C. 154(b) by 0 days.

(21) Appl. No.: 17/465,155

(22) Filed: Sep. 2, 2021

(65) Prior Publication Data

US 2022/0064827 A1 Mar. 3, 2022

Related U.S. Application Data

(60) Provisional application No. 63/074,084, filed on Sep. 3, 2020.

(51) Int. Cl.

| | |
|---|---|
| ***D03D 15/40*** | (2021.01) |
| ***D03D 1/00*** | (2006.01) |
| ***D03D 15/41*** | (2021.01) |
| ***D02G 3/28*** | (2006.01) |
| ***D03D 15/283*** | (2021.01) |
| ***D03D 15/217*** | (2021.01) |

(Continued)

(52) U.S. Cl.

CPC ..... *D03D 15/41* (2021.01); *D02G 3/28* (2013.01); *D03D 1/0017* (2013.01); *D03D 15/217* (2021.01); *D03D 15/225* (2021.01); *D03D 15/283* (2021.01); *D03D 15/43* (2021.01); *D10B 2201/02* (2013.01); *D10B 2201/24* (2013.01); *D10B 2321/06* (2013.01); *D10B 2331/04* (2013.01)

(58) Field of Classification Search

CPC .... D03D 15/41; D03D 1/0017; D03D 15/217; D03D 15/225; D03D 15/283; D03D 15/43; D03D 27/08; D02G 3/28; D10B 2201/02; D10B 2201/24; D10B 2321/06; D10B 2331/04; D01H 1/025; D01H 7/926; D01H 13/04

See application file for complete search history.

(56) References Cited

U.S. PATENT DOCUMENTS 1,481,689 A * 1/1924 Casablancas ..... D01H 13/04 19/293
7,810,308 B2 * 10/2010 Wang ..... D06M 11/40 57/283

(Continued)

FOREIGN PATENT DOCUMENTS

CN 101126190 B 2/2008

*Primary Examiner* — Robert H Muromoto, Jr.
(74) *Attorney, Agent, or Firm* — Leason Ellis LLP

(57) ABSTRACT

A composite low-twist towel that is formed of three parts: terry yarn, ground warp yarn and weft yarn. The ground warp yarn and the weft yarn are normal towel yarns and the terry yarn is a composite low-twist yarn. The composite low-twist yarn is composed of two yarns of different thickness, among them, the spun yarn is synthetic fiber spun yarn or filament yarn, and the thick yarn is the pure cotton yarn or the blended yarn of pure cotton and other fibers. The composite low-twist yarn is made into a warp beam through warping and sizing. Then, it interweaves with ground warp yarns and weft yarns through a towel loom or warp loom to form terry fabrics.

22 Claims, 5 Drawing Sheets

(51) Int. Cl.
*D03D 15/225* (2021.01)
*D03D 15/43* (2021.01)

(56) References Cited

U.S. PATENT DOCUMENTS

| | | | | | |
|---|---|---|---|---|---|
| RE45,243 | E | * | 11/2014 | Wang | A23B 4/08 57/283 |
| RE45,875 | E | * | 2/2016 | Wang | D06M 11/38 |
| 10,047,476 | B2 | * | 8/2018 | Wang | D06P 1/38 |
| 10,161,068 | B2 | * | 12/2018 | Wang | D03D 27/06 |
| 10,538,865 | B2 | * | 1/2020 | Wang | D03D 15/283 |
| 10,655,246 | B2 | * | 5/2020 | Wang | D02G 3/406 |
| 10,655,247 | B2 | * | 5/2020 | Wang | D02G 3/406 |
| 11,286,590 | B2 | * | 3/2022 | Wang | D03D 27/04 |
| 2004/0131821 | A1 | * | 7/2004 | Mandawewala | D02G 3/406 57/238 |
| 2009/0078330 | A1 | * | 3/2009 | Wang | D03D 27/00 139/420 R |
| 2010/0213222 | A1 | * | 8/2010 | Boyko | A47G 25/28 223/85 |
| 2012/0076971 | A1 | * | 3/2012 | Debnath | D02G 3/406 28/165 |
| 2016/0305049 | A1 | * | 10/2016 | Wang | D03D 15/68 |
| 2016/0326689 | A1 | * | 11/2016 | Wang | D06L 1/14 |
| 2017/0370022 | A1 | * | 12/2017 | Wang | D03D 15/50 |
| 2017/0370028 | A1 | * | 12/2017 | Wang | D03D 15/283 |
| 2017/0370029 | A1 | * | 12/2017 | Wang | D03D 15/50 |
| 2019/0257011 | A1 | * | 8/2019 | Goenka | D02G 3/28 |
| 2020/0040491 | A1 | * | 2/2020 | Mittal | D03D 27/08 |
| 2021/0140077 | A1 | * | 5/2021 | Wang | D03D 15/217 |
| 2022/0064827 | A1 | * | 3/2022 | Wang | D02G 3/28 |

* cited by examiner

COMPOSITE LOW-TWIST YARN TOWEL AND PRODUCTION METHOD THEREOF

CROSS-REFERENCE TO RELATED APPLICATION

The present application claims priority to and the benefit of U.S. patent application Ser. No. 63/074,084, filed on Sep. 3, 2020, which is hereby incorporated by reference in its entirety.

TECHNICAL FIELD

The present disclosure relates to the field of textile products and more particularly, relates to a composite low-twist yarn towel and production method thereof. While a towel is one preferred textile in which the composite low-twist yarn can be incorporated, it will be understood that the composite low-twist yarn can be incorporated into other textile articles besides towel products.

BACKGROUND

Towel products are large-quantity and wide-utility daily textiles. Among them, the zero twist towel is one of the top-grade towel products. It is favored by consumers with its unique fluffy, soft hand feel and excellent water absorbency. At present, the method of producing the zero twist towel is to twist a soluble vinylon (synthetic fiber) and a cotton yarn in opposite directions to form a ply yarn. After weaving, 85-90° C. hot water is used to dissolve the soluble vinylon from the ply yarn and, in this way, the twists of cotton yarn is loosened. A zero twist towel is formed as a result of this process. However, in this method, the vinylon is dissolved in water, and the consumption of vinylon is quite large. Moreover, dissolving vinylon into water causes water pollution and great pressure on the water treatment facility of the factory.

The present inventor has a prior application, namely patent No. CN 200710017170.0, that has a title of "Production Method of Zero Twist Towel", which is hereby expressly incorporated by reference in its entirety. Although the towel product obtained through this method successfully overcomes the defects of the existing technology and avoids the water pollution caused by vinylon dissolving in water, however, compared with the traditional PVA twist less yarn towel after use, this obtained towel product is found to have a certain gap in product fluffiness and softness after washing. In addition, there is also a high depilation rate. These problems seriously affect the use of the product. Therefore, how to overcome the defects of the existing technology becomes one of the problems to be solved by the technical personnel in the field.

SUMMARY

In view of the above-described deficiencies of the existing technology, the present disclosure provides a composite low-twist yarn towel and a production method thereof. The composite low-twist towel comprises three parts: terry yarn, ground warp yarn and weft yarn, wherein the ground warp yarn and the weft yarn are normal (conventional) towel yarns and the terry yarn is a composite low-twist yarn. The composite low-twist (terry) yarn is composed of two yarns of different thickness and more specifically is formed of a fine yarn that can be a synthetic fiber spun yarn or filament yarn, and the thick yarn can be pure cotton yarn or the blended yarn of pure cotton and other fibers. The composite low-twist yarn is made into a warp beam through warping and sizing. Then, it interweaves with ground warp yarns and weft yarns through a towel loom or warp loom (or another suitable machine) to form a terry fabric, such as a towel. After dyeing, finishing, and sewing processes, the composite low-twist yarn towel is obtained. Compared with the twist less yarn towel formed by the traditional PVA twisting and untwisting method, the towel formed of the disclosed composite low-twist yarn has similar hand feel, similar softness, appearance and style, but it has the characteristics of lower depilation rate and higher durability, and can obviously improve weaving efficiency.

The adopted technical scheme in the invention to solve the technical problem is that the composite low-twist yarn towel is composed of the following three parts: terry yarn, ground warp yarn and weft yarn. These three yarns are woven together to form the towel or other woven product. The ground warp yarn and the weft yarn are conventional towel yarns and the terry yarn is a composite low-twist yarn. The composite low-twist yarn (terry yarn) is composed of two yarns of different thickness and in particular, is formed of: (1) a fine yarn that is a synthetic fiber spun yarn or filament yarn with weight not higher than 27.8 g/km, and (2) a thick yarn that can be a pure cotton yarn or a blended yarn with pure cotton and other fibers with weight not less than 18.2 g/km, and the twist factor of the thick yarn is not higher than 295.

Based on the above technical scheme and according to one embodiment, the spun yarn (the fine yarn) is regenerated cellulose fiber yarn or filament yarn, and its weight is not higher than 14.5 g/km. The thick yarn is a pure cotton yarn, its weight is not less than 36.4 g/km, and the twist factor of the thick yarn is not more than 258.

The regenerated cellulose fiber yarn or filament yarn (the fine yarn) can be selected from the ordinary viscose yarn, spun yarn or filament yarn such as modal, polynosic viscose, cuprammonium fiber or Lyocell, etc., and synthetic fiber yarn or spun yarn such as terylene, nylon, acrylic, etc.

The above thick yarn and fine yarn materials, used to form the composite low-twist yarn, can be products directly purchased from the market and also can be directly produced according to the existing technology.

The single yarn twist directions of the two yarns (the fine yarn and the thick yarn) in the composite low-twist yarn are the same, and the ply yarn (i.e., the composite low-twist yarn) twist direction and the single yarn twist direction are contrary (opposite); and the twist factor of ply yarn is not higher than 295, further optimized to no higher than 258; the optimal twist factor of ply yarn is not higher than 230.

Compared with the existing technology, especially the above-mentioned prior Chinese patent application 200710017170.0 entitled "Production Method of Zero Twist Towel" by the present inventor, differences of the present invention lie in at least the following features.

First, the composition of the fine yarn is different: the fine yarn composition in the low-twist composite yarn is synthetic fiber (e. g. all kinds of regenerated cellulose fibers, terylene, nylon, etc.), especially a regenerated cellulose fiber such as Lyocell, modal, high tenacity viscose or other types of viscose fiber.

Using the above synthetic fiber (the fine yarn), whose length is longer than that of pure cotton fiber (the length of synthetic fiber is generally 38 mm, while the length of common cotton fiber is generally 28-33 mm), and uniformity is good (the length of synthetic fiber is the same, while the length of natural fiber is different, from 13 mm to 33 mm), is conducive to the improvement of strength of the fine yarn and of the strength of the composite low-twist yarn to further help high-speed weaving. Moreover, the hand feeling of synthetic fiber is better than that of cotton fiber no matter before or after washing for many times. These characteristics of synthetic fiber are also conducive to the reduction of the end product's depilation rate; thus, it has improvement compared with the existing technology.

Second, the twist factor and the twist of the thick yarn are lower than in previous products, and the breaking tenacity is high. The thick yarn of the low-twist composite yarn in the prior application of the present Applicant can be obtained by normal spinning technology. The breaking tenacity limited by the thick yarn need to meet the weaving conditions, and the twist cannot be reduced to the twist of the thick yarn of the composite low-twist yarn in the present invention. The thick yarn of the composite yarn mentioned in the present invention is spun by a specially improved spinning frame and more particularly, certain modifications can be made to a conventional spinning frame. Under the same process conditions and the same twist, compared with the thick yarn in the composite yarn of the prior application, the hairiness with length over 3 mm in the thick yarn can be reduced by more than 20%, and has higher strength by 7.5% or more.

In order to achieve the above-mentioned purpose, the present system (spinning frame equipment) includes special devices (accessories) that are added to a traditional spinning frame, such as a traditional spinning frame FA507, to reduce yarn hairiness and improve yarn strength.

FIG. 1 illustrates an exemplary spinning frame 100 that has been modified in accordance with the present invention. As is generally known in the field, a spinning frame, such as spinning frame 100, is a device for spinning thread or yarn from fibers, such as wool or cotton, in a mechanized way. The spinning frame employs draw rollers to stretch, or attenuate, the yarn. In the spinning frame 100 of FIG. 1, there is a draft back roller 110, a draft middle roller 120 and a draft front roller 130. The roller spinning process starts with a thick 'string' of loose fibers called a roving, shown at 140, which is passed between the three pairs of rollers 110, 120, 130, each pair rotating slightly faster than the previous one. As shown, there can be two or more rovings 140. In this way, the fibers are reduced in thickness and increased in length before undergoing further processing. The spacing of the rollers 110, 120, 130 has to be slightly greater than the fiber length to prevent breakage. The nip of the roller pairs prevents the twist from backing up to the roving 140. The main use of a roving is as a fiber prepared for spinning.

The spinning frame 100 shown in FIG. 1 includes other traditional components, such as a front upper roller drafting 115, an upper roller drawing 125, and a transmission gear 135.

In one exemplary embodiment, the spinning frame 100 is an FA507 type fine spinning machine (siro machine).

In accordance with one or more embodiments, the specific improvements to the equipment can be selected from the following:

(2-1) Add a thick yarn hanging frame of siro spinning device to the FA507 spinning frame 100 and add a coarse sliver cotton collector 200 at the inlet of thick yarn slivers entering the back roller 110, to realize the purpose of spinning the strand-structure yarn on the spinning frame 100. The single strand structure is helpful to the decrease of yarn hairiness and the increase of yarn strength; the added coarse sliver cotton collector is shown at 200 of FIG. 1 and FIG. 2. As is known, a sliver is a long bundle of fiber that is generally used to spin yarn. A sliver is created by carding or combing the fiber, which is then drawn into long strips where the fiber is parallel. The collector 200 can be in the form of a hollow plastic piece that is open at its ends for receiving and permitting passage of the rovings 140.

(2-2) Install a negative pressure suction compact spinning device 210 on FA507 spinning frame 100 so that the compact yarn can be spun on the ordinary ring spinning frame. The spinning principle of the technology is to install the compact spinning negative pressure suction device 210 under the output end of front roller 130, so that the thick yarn slivers is bundled and the floating hairiness of the thick yarn sliver is concentrated on the yarn backbone to reduce hairiness and improve yarn strength. The negative pressure suction compact spinning device is shown at 210 in FIG. 1 and FIG. 3. As is known in the field, in compact spinning, the spinning triangle associated with conventional ring spinning is eliminated by pneumatic compaction, which happens by suction and compaction on a perforated revolving drum/apron in the front zone of the drafting system.

FIGS. 3A and 3B illustrate one negative pressure suction compact spinning device 210 that consists of a main tube or body 211 that has one or more air suction pipes (side connectors) 212 that is in fluid communication with the hollow interior of the main tube 211. The main tube 211 includes one or more inlet holes (not shown) that are formed along its length and open into the hollow interior of the main tube 211.

An air inlet cover 213 is placed over one air inlet hole. FIG. 3B shows the front of the air inlet cover 213 (left image) and shows the back (rear) of the air inlet cover 213 (right image). The air inlet cover 213 includes a pair of slits 216 formed therein to allow passage of air. As shown, the slits 216 are arranged in a non-parallel manner. The air inlet cover 213 is curved so as to be complementary to the curvature of the main tube 211. A breathable grid (membrane or mesh) 215 is then installed over the air inlet cover 213.

(2-3) Add a special tangential belt 220 (installed between the output roller and the guide hook of leaf plate) on FA507 spinning frame to produce false twist effect on the slivers output from the front roller 130. The element 220 can thus be referred to as a false twist device, the sliver twist from the false twister to the output roller and from the false twister and the wire ring is substantially increased, the spinning triangle is eliminated, the hairiness formed by floating fibers on the main body of yarn is greatly reduced, and the yarn strength is also greatly improved with obvious decrease of breakages. As is known, a false twist textured yarn is a continuous filament yarn that has been processed to introduce crimps, coils, loops and other fine distortions along the yarn's length. The speed of false twister (tangential belt) 220 is separately controlled by a servo motor. The sliver output from the front roller 130 forms an included angle through the false twister, showing arc-shaped contact. Set a specific linear speed ratio for the output linear speed of the false twister and the roller, generally between 1.2-1.5. The element 220 is shown in FIG. 1 and FIG. 4.

FIG. 5 shows the combination of modifications.

The separate technical transformation or any combination of technological transformation of (2-1), (2-2) and (2-3) above can significantly improve the spinnability of yarns and the efficiency of machines. After FA507 spinning frame 100 uses this technology with the same twist factor (no more than 295), the breaking strength of single yarn increases by more than 7.5%, and the hairiness with length over 3 mm decreases by more than 20%; for the composite technology of the three process improvements (as shown in FIG. 5) under the condition of meeting the normal weaving yarn strength, the twist factor of single yarn can be reduced to 200 minimum; it helps to make the towel yarn feel soft, and the composite technology of the above three process improvements 200, 210, 220 can be preferred as the best weaving method.

After the modification of the above-mentioned FA507 spinning frame 100, all production parameters remain unchanged. Only when the false twister 220 is added, it is necessary to set the specific linear speed ratio of the false twister to the roller output linear speed, generally between 1.2-1.5.

(3) The hand feel and style of the end product has big differences: since the synthetic fiber yarn or filament, especially the regenerated cellulose fiber yarn or filament, feels softer than the pure cotton yarn of the same thickness, so the towel made of the composite low-twist yarn feels more fluffy and softer than the towel obtained in the prior application. The thickness of the composite low-twist yarn towel in the present invention is 10% thicker than that of the towel made in the prior patent of the applicant; the softness of hand feel is also obviously better than the prior patents, closer to the traditional PVA twist less yarn.

(4) The end product has a lower rate of depilation: Because the synthetic fiber itself has long fiber length and even uniformity, and the thick yarn fiber hairiness in the composite yarn is less than that in the towel obtained by the existing technology, so the depilation rate of the composite low-twist yarn product after 5 washes is at least 0.5% lower than that of the towel obtained by the existing technology.

The applicant further provides the method of producing the composite low-twist yarn towel and the specific steps are as follows:

I. Spinning:

(i) Spin a fine-count yarn (that forms part of the low-twist composite yarn): use conventional cotton spinning technology to spin the synthetic staple fiber or regenerated cellulose fiber or its mixed components. The weight of the spun fine-count yarn is not more than 27.8 g/km, and the twisting direction of the spun fine-count yarn is not fixed, which is further optimized as twisting in the Z-direction. The twisting factor of the spun fine-count yarn is not limited; the composition of the spun fine-count yarn is further optimized as viscose, modal, Lyocell, cuprammonium fiber, polynosic viscose and other regenerated cellulose fibers, and the weight of the spun fine-count yarn is further optimized to be no more than 14.5 g/km; the spinning is carried out in the conventional spinning process.

(ii) Spin a thick count yarn: follow the conventional spinning technology to conduct opening, removing impurities, combing and drawing to the cotton fiber or the mixed fiber of cotton and other fibers to form thick yarn sliver.

Conducting the thick count yarn draft spinning for the thick yarn sliver on the spinning frame is to increase the strength of the thick count yarn and reduce the hairiness of the yarn, and improve the quality of the yarn for a successful weaving. The specific improved device is described as follows:

Installing some special devices on the traditional spinning frame FA507 can reduce yarn hairiness and improve yarn strength. The specific modification ways can be selected from the following:

(ii-1) Add a thick yarn hanging frame of siro spinning device on FA507 spinning frame, and add the thick yarn sliver cotton collector 200 at the inlet of the thick yarn slivers entering the back roller 110, to realize the purpose of spinning the strand-structure yarn on the spinning frame. The single strand structure is helpful to the decrease of yarn hairiness and the increase of yarn strength; the added coarse sliver cotton collector is shown at 200 in FIG. 1 and FIG. 2.

(ii-2) Install a negative pressure suction compact spinning device 210 on FA507 spinning frame so that the compact yarn can be spun on the ordinary ring spinning frame. The spinning principle of the technology is to install a compact spinning negative pressure suction device under the output end of front roller 130, so that the thick yarn slivers is bundled and the floating hairiness of the thick yarn sliver is concentrated on the yarn backbone to reduce hairiness and improve yarn strength.

(ii-3) Add the special tangential belt 220 (installed between the output roller and the guide hook of leaf plate) on FA507 spinning frame to produce false twist effect on the slivers output from the front roller 130. Through the false twist device, the sliver twist from the false twister to the output roller and from the false twister and the wire ring is substantially increased, the spinning triangle is eliminated, the hairiness formed by floating fibers on the main body of yarn is greatly reduced, and the yarn strength is also hugely improved with obvious decrease of breakages. The speed of false twister (tangential belt) is separately controlled by a servo motor. The sliver output from the front roller 130 forms an included angle through the false twister, showing arc-shaped contact. Set a specific linear speed ratio for the output linear speed of the false twister and the roller, generally between 1.2-1.5.

In addition to the above-mentioned draft spinning of thick count yarns using thick yarn sliver on the spinning frame, changing the cotton assorting of thick count yarns can also improve the strength of thick count yarns and reduce the hairiness. For example, by improving yarn the quality of cotton and selecting long-staple cotton (the main length of cotton is 30 mm and above) to achieve the above purpose, or by mixing synthetic fibers such as various terylene, nylon and various regenerated cellulose fibers into cotton.

No matter which method is adopted, the weight of the final thick count yarn shall not be less than 18.2 g/km. The twist factor of the thick yarn spun in this process is not higher than 295, further optimized to that the weight is not less than 36.4 g/km and the twist factor is not higher than 258; thus, the later process can be proceeded.

The twist direction of the thick yarn spun in this process is the same as that of the fine (thin) yarn spun in step (i).

(iii) Doubling: combine the yarns spun in steps (i) and (ii) on the doubling machine.

(iv) Twisting: twist the combined yarn of step (iii) in the opposite twist direction as that of the thick count yarn and fine-count yarns spun in steps (i) and (ii). The twist factor of the stranded yarn is no higher than 295, further optimized to be no higher than 258; the optimal twist factor of stranded yarns is not higher than 230;

(v) Winding: conduct winding for the yarns made in step (iv), and prepare for dyeing or warping.

(vi). Yarn dyeing: if the product is terry fabrics dyed first and then woven, it is necessary to dye the yarn for the terry fabrics first. In order to reduce the loss of yarn strength, the winding tension in the yarn dyeing loosening process should be reduced.

(viii). Warping: conduct warping to the ground warp yarn and the terry yarn according to the process requirements.

(ix). Warp sizing: conduct warp sizing to the pile warp beam and the ground warp beam respectively, and the ground warp sizing can follow the conventional technical scheme. For the warp sizing of the pile warp beam, use the sizing method of "single soaking and single pressing" heavy covering to reduce the breakage of the pile warp yarn.

(x). Weaving: weave the terry fabric on a towel loom or warp loom.

(xi). Greige dyeing finishing: conduct relevant dyeing and finishing for the terry fabric woven in the previous working procedure.

(xii). Dehydration, drying or setting: dehydrate, dry, and set the above dyed fabric.

(xiii). Sew the fabric into the required finished terry fabric: curl, sew and make the above products into products required.

Besides, other production steps not mentioned in this invention shall be completed using the existing technology; the adopted process parameters and the parameters in the prior application of the applicant can be the same.

In addition, since the PVA is no longer used in the technical scheme of the present invention, the PVA consumption per ton of yarn decreases by 5.5%-13%; the COD index of wastewater formed by PVA in the existing technology is about 21,000, while the COD index of wastewater formed by obtaining towel in this technical scheme is less than 10,000, which is due to no longer using PVA; meanwhile, it also makes the yield rate of this invention increase by 5%-13% compared with the existing technology, greatly improving yarn the production efficiency; the depilation rate of the product after 5 washes (AATCC 135 washing method) is 0.1% less than that of the traditional twist less yarn and 0.05% less than that of the prior patent.

The hand feel and fluffy degree of the product obtained by this invention are close to that of the traditional PVA twist less yarn, mainly because the thick yarn twist in the composite low-twist yarn (formed by stranded, twisting and untwisting) is very close to or equal to that of the traditional twist less yarn (actually the traditional twist less yarn also retains a very small twist), and the wrapping and binding of the synthetic fiber spinning to the thick yarn is smaller than that of pure cotton, therefore, the hand feel and fluffy degree are close to that of the traditional twist less yarn. Compared with the prior patent, the reason why the hand feel and fluffy degree of the product obtained by this invention are superior to the prior patent is that the thick yarn twist adopted is small and the hand feel of the synthetic fiber is good.

Compared with the twist less yarn towel produced by the traditional PVA twist and untwist method, the composite twist less yarn produced by the above method has the characteristics of similar handle softness, similar appearance style, lower depilation rate and higher durability, and it can obviously improve the weaving efficiency.

BRIEF DESCRIPTION OF THE DRAWING FIGURES

DETAILED DESCRIPTION OF CERTAIN EMBODIMENTS

Figure 1:
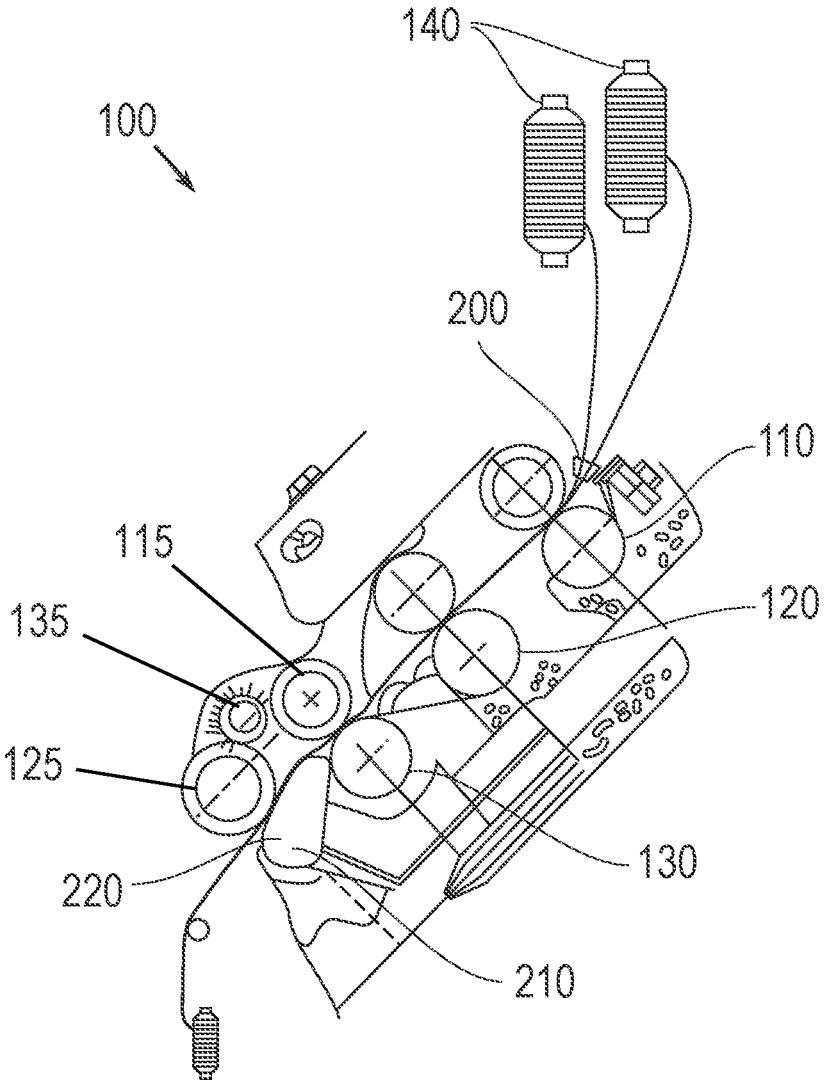
FIG. 1 is a structural diagram of modifications that define an improved FA507 spinning frame adopted by this invention.
Figure 2:
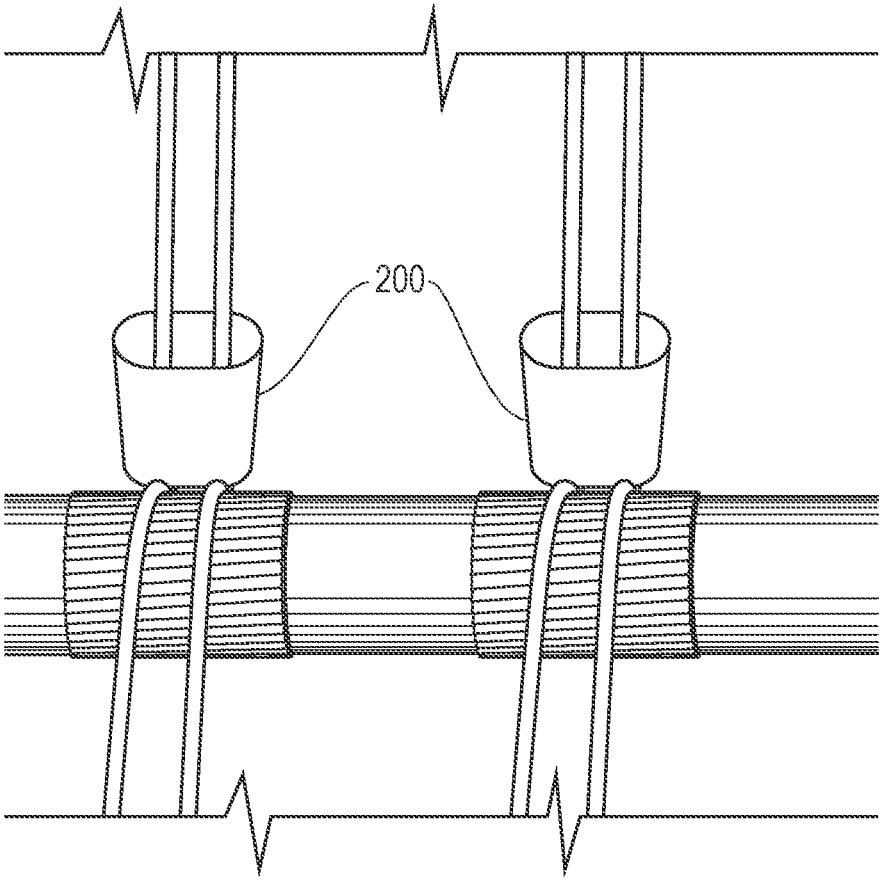
FIG. 2 shows a siro spinning cotton collector that is part of an FA507 spinning frame added with a siro spinning device.
Figure 3A:
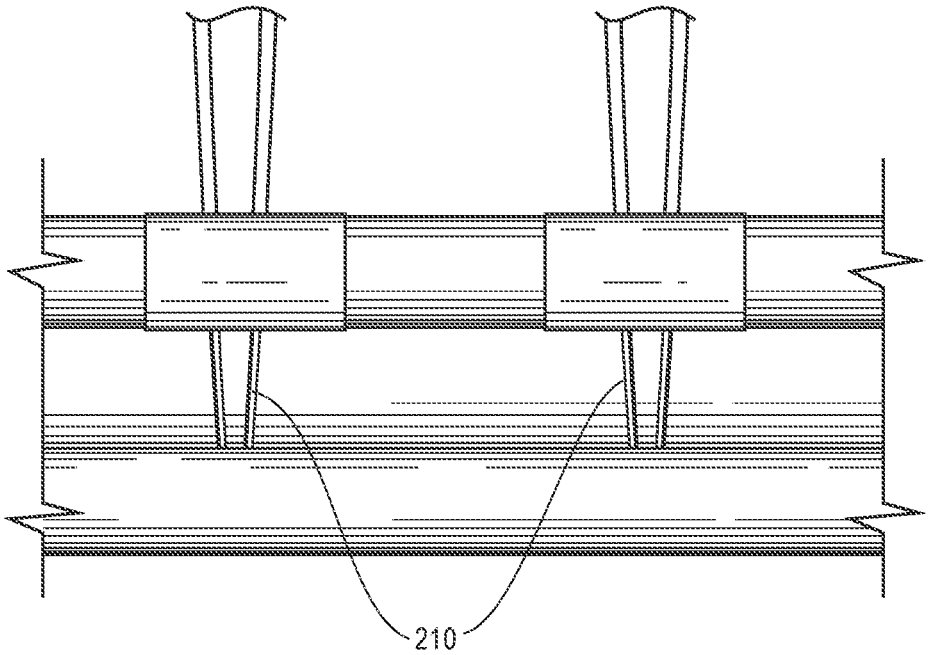
FIG. 3A is a negative pressure suction pipe of the FA507 spinning frame added with a compact spinning device.
Figure 3B:
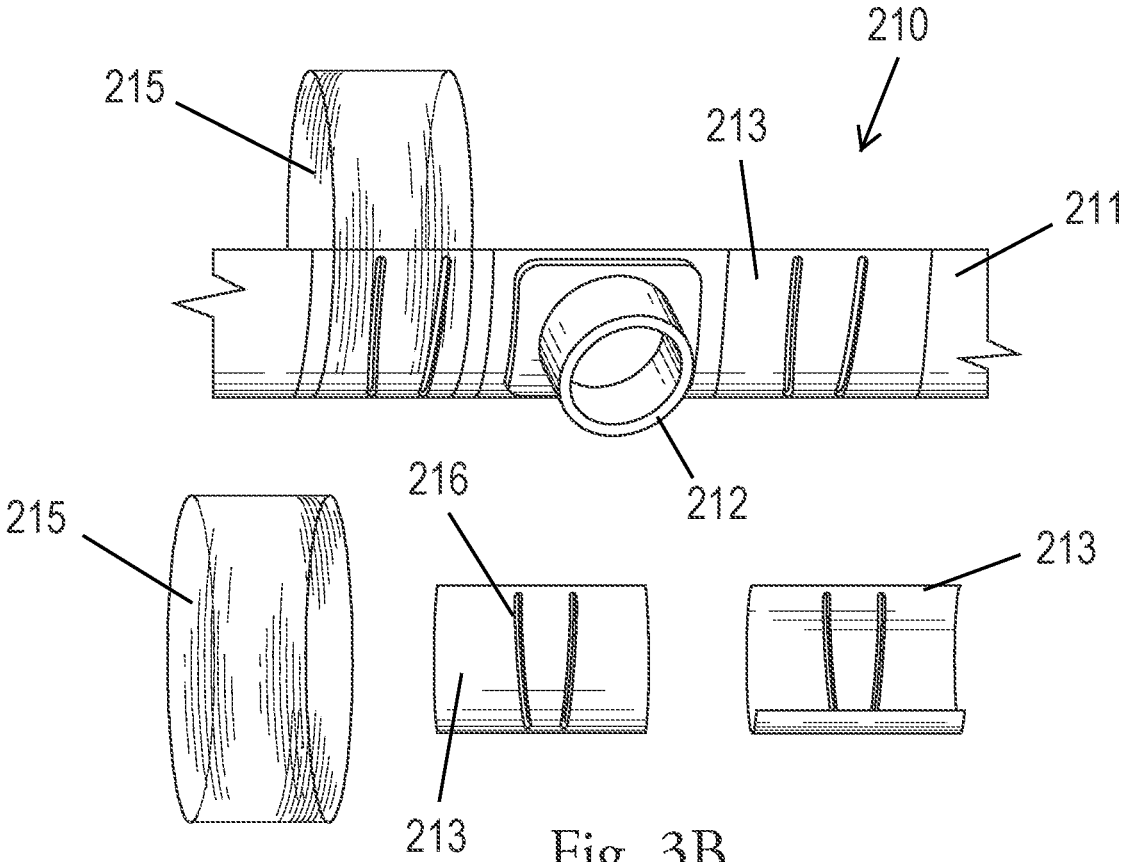
FIG. 3B is an exploded view of the negative pressure suction pipe.
Figure 4:
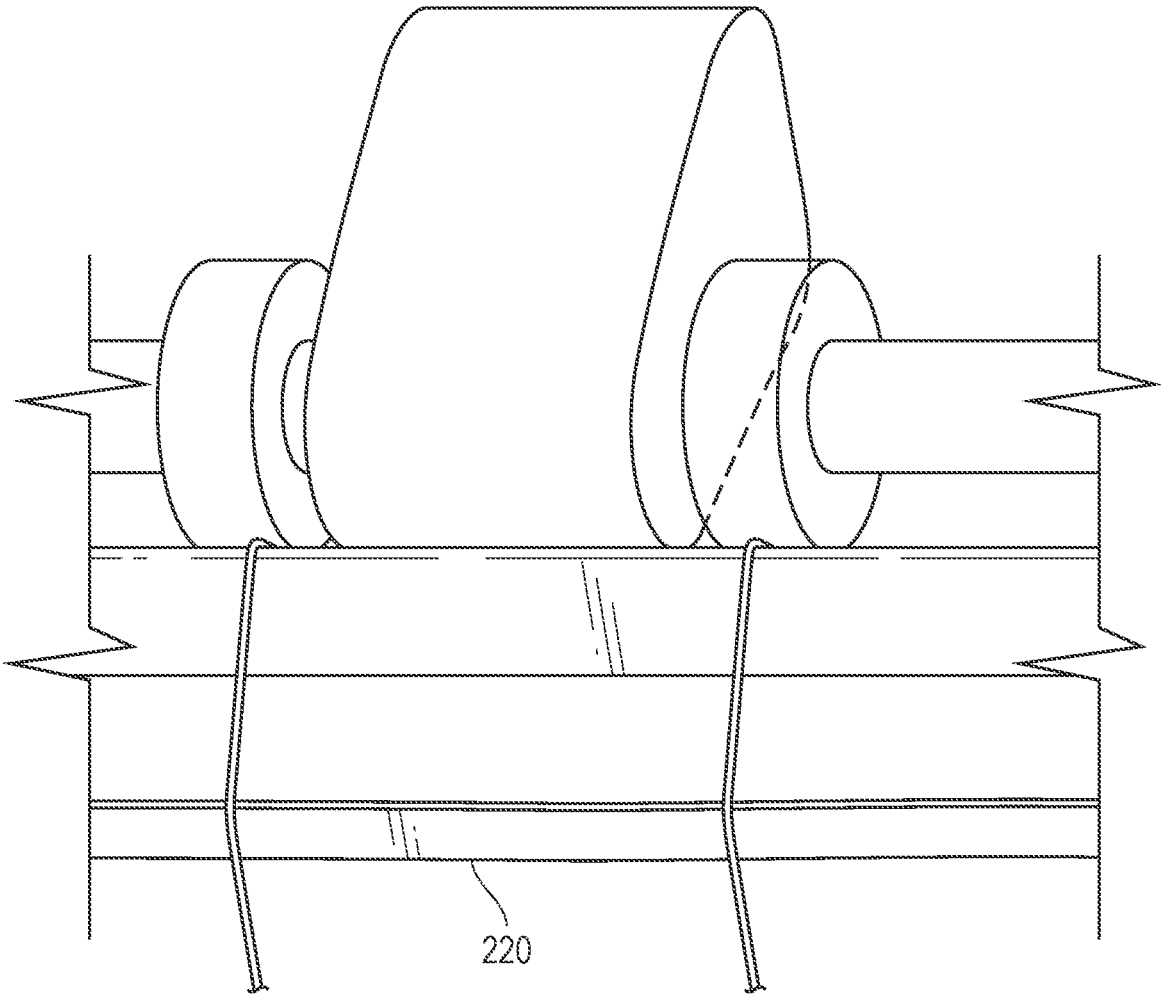
FIG. 4 is a view of the FA507 spinning frame added with a false twist device.
Figure 5:
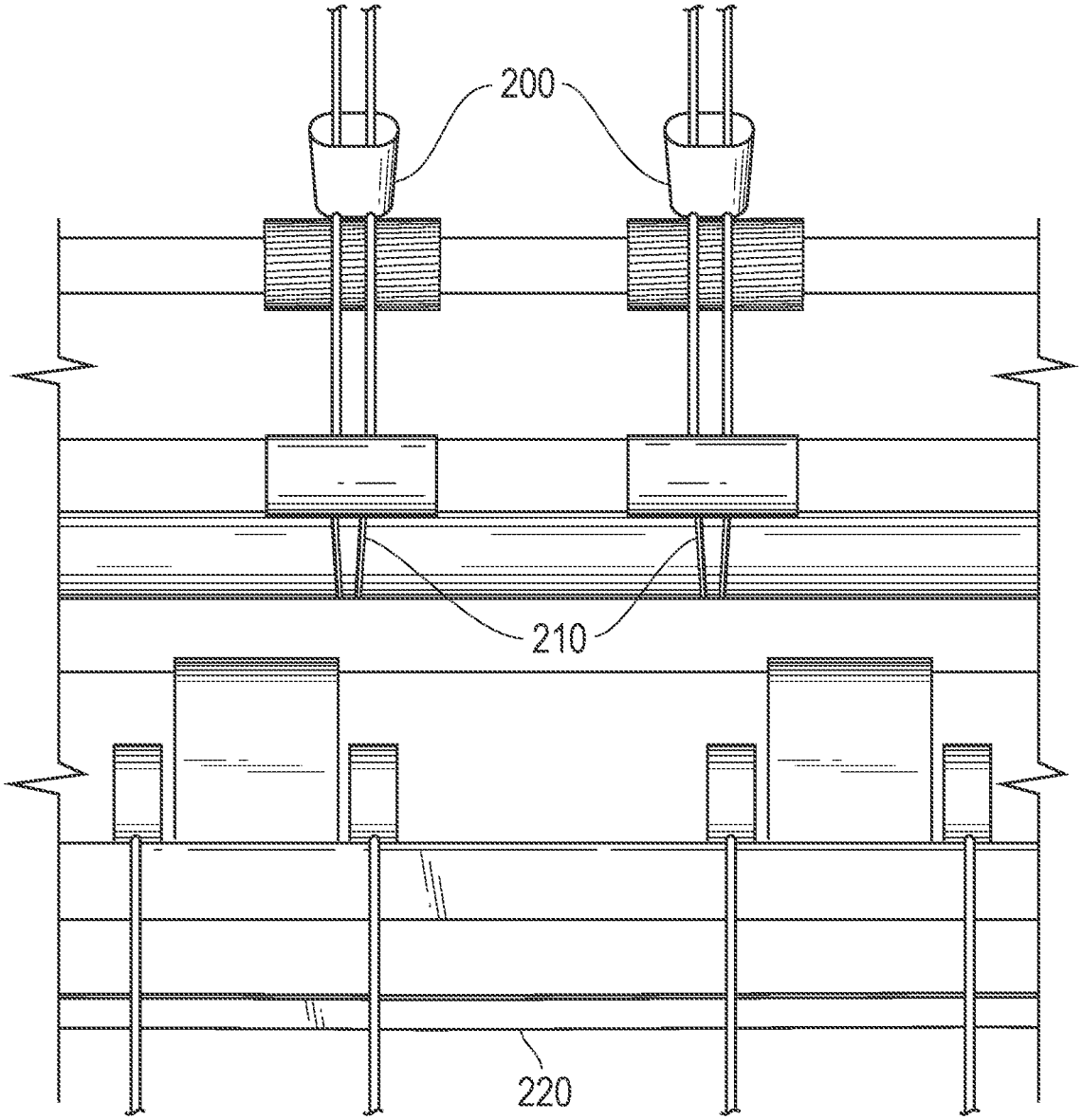
FIG. 5 is a view of the FA507 spinning frame added with a siro spinning device, compact spinning device and false twist device in sequence.

The follow description sets forth exemplary composite low-twist yarn towels and production methods thereof. It will be appreciated that the following examples are exemplary and not limiting of the scope of the present invention.

Embodiment 1

A composite low-twist yarn towel and production method thereof are described.

Take woven terry fabrics as an example: the specific steps are as follows:

(1) Fiber selection of the composite low-twist yarn: the fine-count yarn is 100% viscose fiber and the thick count yarn is 100% cotton, in which the viscose fiber produced by Sichuan Yibin Grace Group Company with the trade name of Gracell and the model of 1.1 dtexx38 mm is used here.

(2) The thick yarn count of the composite low-twist yarn is 48.6 tex, and the fine yarn count of the composite low-twist yarn is 7.3 tex.

(3) The twist of the thick count yarn of the composite low-twist yarn is: any twist not higher than the twist factor 295, the twist of fine-count yarn is 130t/10 cm, and the twist directions of thick count yarn and fine-count yarn are both Z-direction twist.

(4). The thick count yarn of the composite low-twist yarn is spun on the improved spinning frame, using siro, compact, false twist or its composite improved device. According to the different modification modes of the spinning frame, the specific process is as follows:

(A) The process parameters of spinning thick count yarn on the spinning frame added with siro spinning are as follows: the weight of the thick yarn is 8 g/10 m×2 pieces, and the number of spun yarns is 48.6 tex; total drafting multipliers: 36.4 times, the design twist is 39 twists/10 cm, the spindle speed is 7950 rpm (revolutions per minute), and the front roller speed is 256 rpm. Under the same technological conditions, compared with the thick count yarn obtained from the conventional ring spinning, the thick-count yarn obtained using this method has higher average strength: 5.3%, the number of roots of the hairiness with length 3 mm decreases by 8%, and the coefficient of strength variation decreases by 0.3%.

(B) The process parameters of spinning the thick count yarn on the spinning frame added with compact spinning are as follows: the weight of the thick yarn is 8 g/10 m, and the number of spun yarns is 48.6 tex; total drafting multipliers: 18.2 times, the design twist is 39 twists/10 cm, the spindle speed is 7950 rpm (revolutions per minute), and the front roller speed is 256 rpm. Under the same technological conditions, compared with the thick count yarn obtained from the conventional ring spinning, the thick count yarn obtained using this method has higher average strength: 7.8%, the number of roots of the hairiness with length 3 mm decreases by 20%, and the coefficient of strength variation decreases by 0.8%.

(C) The process parameters of spinning thick count yarns on the spinning frame equipped with siro spinning and compact spinning composite device are as follows: the weight of the thick yarn is 8 g/10 m×2 pieces, and the number of spun yarns is 48.6 tex; total drafting multipliers: 36.4 times, the design twist is 39 twists/10 cm, the spindle speed is 7950 rpm (revolutions per minute), and the front roller speed is 256 rpm. Under the same technological conditions, compared with the thick count yarn obtained from the conventional ring spinning, the thick count yarn obtained using this method has higher average strength: 12.2%, the number of roots of the hairiness with length 3 mm decreases by 24.5%, and the coefficient of strength variation decreases by 1.9%.

(D) The process parameters of spinning thick count yarns on the spinning frame equipped with siro spinning, compact spinning and false twist composite device are as follows: the weight of the thick yarn is 8 g/10 m×2 pieces, and the number of spun yarns is 48.6 tex; total drafting multipliers: 36.4 times, the designed number of twists is 39 twists/10 cm, the spindle speed is 7950 rpm, the front roller speed is 256 rpm, and the ratio of the linear speed of the front roller to the linear speed of the false twist tangential belt is 1.33. Under the same technological conditions, compared with the thick count yarn obtained from the conventional ring spinning, the thick count yarn obtained using this method has higher average strength: 28.4%, the number of roots of the hairiness with length 3 mm decreases by 32.7%, and the coefficient of strength variation decreases by 2.7%.

The following table shows the comparison of main indexes of thick count yarns obtained under the same environment, same cotton assorting and same process conditions:

| Spinning methods | Ordinary ring spinning | Siro spinning | Compact spinning | Siro compact spinning | Siro compact false twist composite spinning |
|---|---|---|---|---|---|
| Average strength CN | 678 | 714.1 | 731.2 | 760.6 | 870.4 |
| Number of roots of the hairiness with length 3 mm | 49 | 45 | 39 | 37 | 33 |
| Strength coefficient of variability % | 7.5% | 7.2% | 6.7% | 5.6% | 4.8% |

It can be seen that the spinning frame equipped with siro, compact spinning and false twist composite devices is the optimal choice (see last column on the right in above table). Other modification methods can be selected or combined randomly according to weaving requirements.

This embodiment uses method D, which is the combination of compact spinning, siro spinning and false twist technologies.

(5) The thick count yarn and fine-count yarn of the composite low-twist yarn are combined and twisted to form the composite low-twist yarn. Its number of strand twists is 26 t/10 cm, and its twist direction is S-twist.

(6) The ground warp yarn and the weft yarn of the composite low-twist towel fabric are 21s/2 and 16s respectively; conduct warping for the 21s/2 ground warp yarn of the composite low-twist towel fabric and the 48.6 tex/7.3 tex composite low-twist pile warp yarn separately to form the ground warp beam and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 16s weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). Conduct desizing, bleaching, dyeing, polishing, soaping, softening, dehydration, scutching, drying and setting for the low-twist composite terry fabrics woven in step (8) to form the low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 48.6 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 48.6 t cotton/ 7.3 t composite low-twist towel | 10 | 1.37 | 8740 | 8 | 5.1 |
| 48.6 t cotton/ 7.3 PVA twist less towel | 21 | 2.89 | 21804 | 16.3 | 7.2 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2 (which is hereby expressly incorporated herein by reference in its entirety): the thickness of the composite low-twist yarn towel in the present invention is 10% higher; the softness of hand feel is also obviously better than the prior patents, closer to the traditional PVA twist less yarn.

All publications, patents and patent applications referred to herein are incorporated by reference in their entirety to the same extent as if each individual publication, patent or patent application was specifically and individually indicated to be incorporated by reference in its entirety Embodiment 2

A composite low-twist yarn towel and production method thereof are described below.

Take woven terry fabrics as an example: the specific steps are as follows:

(1) Fiber selection of the composite low-twist yarn: the fine-count yarn is 100% modal fiber. The modal fiber is a commodity of modal with the model of 1.3 dtex×38 mm produced by Austrian Lenzing Company with the trade name of LENZING™ Modal. The thick count yarn is 100% cotton.

(2) The coarse yarn count of the composite low-twist yarn is 41.6 tex, and the fine yarn count of the composite low-twist yarn is 7.3 tex.

(3) The twist of the thick count yarn of the composite low-twist yarn is: any twist not higher than the twist factor 295, the twist of fine-count yarn is 120t/10 cm, and the twist directions of thick count yarn and fine-count yarn are both Z-direction twist.

(4). The thick count yarn of the composite low-twist yarn is spun on the improved or added spinning frame, using siro, compact, false twist or its composite improved device. In this embodiment, the method C in embodiment 1 is selected for improvement, and the final thick count yarn obtained is about 12% higher than the strength of the yarn not improved, and the hairiness with length 3 mm and above decreases by 25%.

(5) The thick count yarn and fine-count yarn of the composite low-twist yarn are combined and twisted to form the composite low-twist yarn. Its number of strand twists is 20 t/10 cm, and its twist direction is S-twist.

(6) The ground warp yarn and the weft yarn of the composite low-twist towel fabric are 48.6 tex and 36.4 tex respectively; conduct warping for the 48.6 tex ground warp yarn of the composite low-twist towel fabric and the 41.6 tex/7.3 tex composite low-twist pile warp yarn separately to form the ground warp beam and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 36.4 tex weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). Conduct desizing, bleaching, dyeing, polishing, soaping, softening, dehydration, scutching, drying and setting for the low-twist composite terry fabrics woven in step (8) to form the low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 48.6 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 48.6 t cotton/ 7.3 t modal composite low-twist towel | 10 | 1.30 | 8364 | 7.5 | 4.9 |
| 48.6 t cotton/ 7.3 PVA twist less towel | 21 | 2.9 | 20962 | 15.7 | 7.2 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2, it has the advantages of soft hand feel, low depilation rate, more stable yield efficiency.

Embodiment 3

A composite low-twist yarn towel and production method thereof are described below.

Take woven terry fabrics as an example: the specific steps are as follows:

(1) Fiber selection of the composite low-twist yarn: the fine-count yarn is 100% Lyocell fiber, which is the brand of LENZING™ Lyocell A100 produced by Austrian Lenzing company, and the model is: 1.56 dtex×38 mm, the thick count yarn is 100% cotton.

(2) The coarse yarn count of the composite low-twist yarn is 97.2 tex, and the fine yarn count of the composite low-twist yarn is 27.8 tex.

(3) The twist of the thick count yarn of the composite low-twist yarn is: any twist not higher than the twist factor 295, the twist of fine-count yarn is 120t/10 cm, and the twist directions of thick count yarn and fine-count yarn are both Z-direction twist.

(4) The thick count yarn of the composite low-twist yarn is spun on the improved or added spinning frame. In this embodiment, the 97.2 tex thick count yarn is spun on the spinning frame equipped with siro spinning. The specific process parameters are as follows: the weight of the thick yarn is 8 g/10 m×2 pieces, and the number of spun yarns is 97.2 tex; total drafting multipliers: 18.20 times, the design twist is 29.6 twists/10 cm, the spindle speed is 6190 rpm (revolutions per minute), and the front roller speed is 266 rpm. Compared with the conventional ring spinning under the same process conditions, the average strength of the thick count yarn obtained by this method increases by 4.7%, the number of roots of the hairiness with length 3 mm decreases by 3.2%, and the coefficient of strength variation decreases by 0.41%, meeting the weaving requirements.

(5) The thick count yarn and fine-count yarn of the composite low-twist yarn are combined and twisted to form the composite low-twist yarn. Its number of strand twists is 26 t/10 cm, and its twist direction is S-twist.

(6) The ground warp yarn of the composite low-twist towel fabric is 24.3 tex/2 stranded yarn, and the weft yarn is 36.4 tex; warping the 24.3 tex/2 stranded ground warp and 97.2 tex/27.8 tex composite low-twist pile warp of the composite low-twist towel separately to form the ground warp bean and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 16s weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). Conduct desizing, bleaching, dyeing, polishing, soaping, softening, dehydration, scutching, drying and setting for the low-twist composite terry fabrics woven in step (8) to form the low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 97.2 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 97.2 t cotton/ 27.8 t lyocell composite low-twist towel | 10 | 1.37 | 8548 | 7.9 | 4.5 |
| 97.2 t cotton/ 7.3 PVA twist less towel | 21 | 2.89 | 17546 | 12.4 | 6.8 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2, it has the advantages of soft hand feel, low depilation rate, more stable yield efficiency.

Embodiment 4

A composite low-twist yarn towel and production method thereof are described below.

Take woven terry fabrics as an example: the specific steps are as follows:

(1) Fiber selection of the composite low-twist yarn: the fine-count yarn is 75D/72F viscose filament, the fine-count yarn filament uses the man-made filament produced by Jilin Chemical Fiber Group Company, and the thick count yarn is 100% cotton.

(2) The coarse yarn count of the composite low-twist yarn is 48.6 tex, the fine-count yarn is 75D/72F FDY viscose (equivalent to 8.33 tex).

(3) The number of twists of the thick count yarn of the composite low-twist yarn is: any twist not higher than the twist factor 295, the twist direction of the thick count yarn is Z-twist.

(4). The thick count yarn of the composite low-twist yarn is spun on the improved or added spinning frame, using siro, compact, false twist or its composite improved device. In this embodiment, the method D in embodiment 1 is selected for improvement, and the final thick count yarn obtained is about 10% higher than the strength of the yarn not improved, and the hairiness with length 3 mm and above decreases by 30%.

(5) The thick count yarn and fine-count yarn of the composite low-twist yarn are combined and twisted to form the composite low-twist yarn. Its number of strand twists is 26 t/10 cm, and its twist direction is S-twist.

(6) The ground warp yarn and the weft yarn of the composite low-twist towel fabric are 27.8 tex/2 and 36.4 tex respectively; conduct warping for the 27.8 tex/2 ground warp yarn of the composite low-twist towel fabric and the 48.6 tex/75D composite low-twist pile warp yarn separately to form the ground warp beam and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 36.4 tex weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). Conduct desizing, bleaching, dyeing, polishing, soaping, softening, dehydration, scutching, drying and setting for the low-twist composite terry fabrics woven in step (8) to form the low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 48.6 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 48.6 ton cottons/75D viscose composite low-twist towel | 10 | 1.3 | 7956 | 7.7 | 5.1 |
| 48.6 t cotton/7.3 PVA twist less towel | 21 | 2.92 | 20946 | 16 | 7.2 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2, it has the advantages of soft hand feel, low depilation rate, more stable yield efficiency.

Embodiment 5

A composite low-twist yarn towel and production method thereof are described below.

Take woven terry fabrics as an example: the specific steps are as follows:

(1) Fiber selection of the composite low-twist yarn: the fine-count yarn is 100% polyester staple fiber, which uses the recycled polyester staple fiber produced by Hangzhou Benma Chemical Fiber Spinning Company, and the model is: 1.1 dtexx38 mm, the thick count yarn is 100% cotton.

(2) The coarse yarn count of the composite low-twist yarn is 18.2 tex, and the fine yarn count of the composite low-twist yarn is 7.3 tex.

(3) The twist of the thick count yarn of the composite low-twist yarn is: any twist not higher than the twist factor 295, the twist of fine-count yarn is 130t/10 cm, and the twist directions of thick count yarn and fine-count yarn are both Z-direction twist.

(4) The thick count yarn of the composite low-twist yarn is spun on the improved (modified) spinning frame as described herein. The improved spinning frame 100 selected in this embodiment is a spinning frame equipped with siro spinning, compact spinning and false twist composite devices. The process parameters of the 18.2 tex thick count yarn are as follows: the weight of the thick yarn is 3.5 g/10 m×2 pieces, and the number of spun yarns is 18.2 tex; total drafting multipliers: 42.7 times, the designed number of twists is 60 twists/10 cm, the spindle speed is 10320 rpm, the front roller speed is 219 rpm, and the ratio of the linear speed of the front roller to the linear speed of the false twist tangential belt is 1.33. The main indexes of thick count yarns obtained by this method are as follows: average strength: 276.2CN, the number of roots of the hairiness with length 3 mm is 37 counts/10 m, the coefficient of strength variation is 6.6%, meeting the weaving requirements. The conventional ring spinning can't produce the yarn of this twist without adding siro spinning, compact spinning and false twist compound devices.

(5) The thick count yarn and fine-count yarn of the composite low-twist yarn are combined and twisted to form the composite low-twist yarn. Its number of strand twists is 15 t/10 cm, and its twist direction is S-twist.

(6) The ground warp yarn and the weft yarn of the composite low-twist towel fabric are 14.5 tex/2 and 27.8 tex respectively; conduct warping for the 14.5 tex/2 ground warp yarn of the composite low-twist towel fabric and the 18.2 tex/7.3 tex composite low-twist pile warp yarn separately to form the ground warp beam and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 27.8 tex weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). The low-twist composite terry fabric in step (8) is desized and bleached according to the process of polyester cotton blended fabrics, and divided into two steps of dyeing (dyeing polyester first and then cotton), polishing, soaping, softening and dehydration, scutching, drying and setting to form low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 18.2 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 18.2 t cotton/7.3 t polyester composite low-twist towel | 10 | 1.32 | 8543 | 8 | 5.0 |
| 18.2 t cotton/7.3 PVA twist less towel | 21 | 2.95 | 29775 | 22.5 | 7.1 |

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 48.6 ton cottons/75D viscose composite low-twist towel | 10 | 1.3 | 7956 | 7.7 | 5.1 |
| 48.6 t cotton/ 7.3 PVA twist less towel | 21 | 2.92 | 20946 | 16 | 7.2 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2, it has the advantages of soft hand feel, low depilation rate, more stable yield efficiency.

Embodiment 6

A composite low-twist yarn towel and production method thereof are described below.

Take woven terry fabrics as an example: the specific steps are as follows:

(1) Fiber selection of the composite low-twist yarn: the fine-count yarn is 100% modal fiber. The modal fiber is a commodity of modal with the model of 1.3 dtex×38 mm produced by Austrian Lenzing Company with the trade name of LENZING™ Modal. The thick count yarn is 100% cotton.

(2) The coarse yarn count of the composite low-twist yarn is 41.6 tex, and the fine yarn count of the composite low-twist yarn is 7.3 tex.

(3) The twist of the thick count yarn of the composite low-twist yarn is: any twist not higher than the twist factor 295, the twist of fine-count yarn is 120t/10 cm, and the twist directions of thick count yarn and fine-count yarn are both Z-direction twist.

(4). The thick count yarn of the composite low-twist yarn meets the quality requirements of the later process by improving yarn the grading cotton assorting to achieve its strength and hairiness index. The specific cotton assorting of thick count yarns is as follows: the cotton assorting of spinning thick count yarns is 50% long staple cotton (the fineness of the long staple cotton is about 1.6 dtex, and the length of main body of the long staple cotton is about 35 mm) and 50% fine staple cotton (the fineness of the long staple cotton is about 1.5 dtex, and the length of main body of the long staple cotton is about 28 mm). After the process of clearing, carding, combing, drawing and thick yarn according to the conventional technology, 12 s 35 twists/10 cm yarns can be obtained on the ordinary spinning frame according to the conventional technical means.

(5) The thick count yarn and fine-count yarn of the composite low-twist yarn are combined and twisted to form the composite low-twist yarn. Its number of strand twists is 20 t/10 cm, and its twist direction is S-twist.

(6) The ground warp yarn and the weft yarn of the composite low-twist towel fabric are 48.6 tex and 36.4 tex respectively; conduct warping for the 48.6 tex ground warp yarn of the composite low-twist towel fabric and the 41.6 tex/7.3 tex composite low-twist pile warp yarn separately to form the ground warp beam and the pile warp beam respectively.

(7). Conduct sizing for the warp beams formed in step (6) separately to form the ground warp beam and the pile warp beam respectively. For the pile warp beam sizing, the sizing method of single immersion single compression should be used to reduce the number of pile warp breakages and ensure smooth weaving.

(8). Using the pile warp and ground warp of step (7) and the 36.4 tex weft yarn to weave on a shuttle less towel loom to produce the low-twist composite semi-finished terry fabrics, or only use the pile warp and ground warp of step (7) to weave on the warp knitting towel loom to produce the warp knitting low-twist composite terry fabrics.

(9). Conduct desizing, bleaching, dyeing, polishing, soaping, softening, dehydration, scutching, drying and setting for the low-twist composite terry fabrics woven in step (8) to form the low-twist composite terry fabrics. The above procedures are all conventional technical means.

(10). Cutting and sewing the low-twist composite terry fabrics formed in step (9) to form a soft and fluffy low-twist composite terry fabric product.

The low-twist composite terry fabric formed by the above technical scheme has the following benefits:

(i) Compared with traditional water-soluble or alkali soluble twist less terry fabrics: low pollution, low energy consumption, high yield, low depilation rate, similar product hand feel and fluffy degree; compared with the twist less yarn towel produced using the 48.6 tex/80s PVA yarn, the benefits are as follows:

| Variety | Water for pre-treatment (ton/ton yarn) | Steam for pre-treatment (ton/ton yarn) | COD (Chemical Oxygen Demand) index of pre-treatment | Weight loss rate of product % | AATCC (American Association of Textile Chemists and Colorists) Standard 135 Product depilation rate % after 5 washes |
|---|---|---|---|---|---|
| 48.6 t cotton/ 7.3 t modal composite low-twist towel | 10 | 1.30 | 8465 | 7 | 3.5 |
| 48.6 t cotton/ 7.3 PVA twist less towel | 21 | 2.9 | 20973 | 15.3 | 7.2 |

Note: This test data is obtained under the same cotton assorting, the same pre-treatment process conditions, the same dyeing and post-treatment conditions. This data may vary slightly with different colors and different cotton assorting.

(ii). Compared with the terry fabric with patent No. U.S. Pat. No. 7,810,308B2, it has the advantages of soft hand feel, low depilation rate, more stable yield efficiency.

What is claimed is:

1. A composite low-twist yarn towel, comprising:

a terry yarn;

a ground warp yarn and a weft yarn;

wherein the terry yarn comprises a composite low-twist yarn that is composed of first and second yarns of different thickness, the first yarn comprising a fine yarn that is a synthetic fiber spun yarn or a filament yarn with a weight not higher than 27.8 g/km, and the second yarn is a thick yarn that is a pure cotton yarn or a blended yarn with pure cotton and other fibers with a weight not less than 18.2 g/km, and the twist factor of the thick yarn is not higher than 295, and wherein a twist of the fine yarn is 130t/10 cm and twist directions of the fine yarn and the thick yarn are both Z-direction twist.

2. The composite low-twist yarn towel according to claim 1, wherein single yarn twist directions of the two yarns in the composite low-twist yarn are the same, and a twist direction of the composite low-twist yarn is opposite to the single yarn twist directions of the two yarns and twists of the composite low-twist yarn are not higher than 30 per decimeter.

3. The composite low-twist yarn towel according to claim 1, wherein the fine yarn comprises a synthetic yarn and the thick yarn comprises a natural fiber.

4. The composite low-twist yarn towel according to claim 3, wherein the fine yarn comprises 100% modal fiber and the thick yarn comprises 100% cotton fiber.

5. The composite low-twist yarn towel according to claim 1, wherein the fine yarn comprises 100% viscose fiber and the thick yarn comprises 100% cotton fiber.

6. The composite low-twist yarn towel according to claim 5, wherein the composite low-twist yarn has a thick count of 48.6 tex and a fine yarn count of the composite low-twist yarn is 7.3 tex.

7. The composite low-twist yarn towel according to claim 1, wherein a number of twists in the composite low-twist yarn is 26t/10 cm.

8. A composite low-twist yarn towel, comprising:

a terry yarn;

a ground warp yarn and a weft yarn;

wherein the terry yarn comprises a composite low-twist yarn that is composed of first and second yarns of different thickness, the first yarn comprising a fine yarn that is a regenerated cellulose fiber yarn or a filament yarn, and a weight of the fine yarn is not higher than 14.5 g/km, and the second yarn is a thick yarn that is a pure cotton yarn, a weight of the thick yarn is not less than 36.4 g/km, and the twist factor of the thick yarn is not more than 258.

9. The composite low-twist yarn towel according to claim 8, wherein the fine yarn comprises one of a viscose yarn, a synthetic fiber yarn, and a spun yarn.

10. The composite low-twist yarn towel according to claim 8, wherein the fine yarn comprises spun yarn selected from the group consisting of terylene, nylon, and acrylic.

11. The composite low-twist yarn towel according to claim 8, wherein the fine yarn comprises filament yarn selected from the group consisting of modal, polynosic viscose, cuprammonium fiber and Lyocell.

12. A method of producing a composite low-twist yarn product comprising the steps of:

forming a terry yarn that comprises a composite low-twist yarn that is composed of first and second yarns of different thickness, the first yarn comprising a fine count yarn that is a synthetic fiber spun yarn or a filament yarn with a weight not higher than 27.8 g/km, and the second yarn is a thick count yarn that is a pure cotton yarn or a blended yarn with pure cotton and other fibers with a weight not less than 18.2 g/km, and the twist factor of the thick count yarn is not higher than 295; and warping a ground warp yarn and the composite low-twist yarn that serves as a low-twist pile warp yarn; and weaving on a towel loom or a warp loom using the ground warp yarn, the composite low-twist yarn and a weft yarn to form the low-twist yarn product, and wherein a twist of the fine count yarn is 130t/10 cm and twist directions of the fine count yarn and the thick count yarn are both Z-direction twist.

13. The method of claim 12, wherein the step of forming the terry yarn comprises the steps of:

spinning the fine-count yarn with a twist direction of the spun fine-count yarn being in the Z-direction;

spinning the thick count yarn with a twist direction of the spun thick count yarn being the first Z direction;

combining the spun fine count yarn and the spun thick count yarn on a doubling machine to form a combined yarn; and twisting the combined yarn in a second direction that is opposite to the first direction to form the twisted combined yarn that comprises the terry yarn.

14. The method of claim 13, further including the steps of:

winding the twisted combined yarn and preparing the twisted combined yarn for dyeing or warping.

15. The method of claim 12, wherein the step of warping comprises the step of conducting warp sizing to a pile warp beam and a ground warp beam respectively.

16. The method of claim 12, further including the step of dying the composite low-twist yarn prior to the weaving step.

17. The method of claim 13, wherein the step of spinning the thick count yarn comprises the steps of:

conducting a thick count yarn draft spinning for thick yarn slivers on a spinning frame to increase a strength of the thick count yarn and reduce hairiness of the thick count yarn, and improve the quality of the thick count yarn for a successful weaving, wherein the spinning frame includes at least one of the following modifications:

(1) adding a thick yarn hanging frame to the spinning frame, and adding a coarse sliver cotton collector at an inlet of the thick yarn slivers entering a back roller of the spinning frame;

(2) installing a negative pressure suction compact spinning device on the spinning frame under an output end of a front roller, so that the thick yarn slivers are bundled and a floating hairiness of the thick yarn sliver is concentrated on a yarn backbone to reduce hairiness and improve yarn strength; and (3) adding a tangential belt which is installed between an output roller and a guide hook or leaf plate on the spinning frame to produce a false twist effect on the thick yarn slivers output from the front roller, through a false twist device.

18. A method of producing a composite low-twist yarn product comprising the steps of:

forming a terry yarn that comprises a composite low-twist yarn that is composed of first and second yarns of different thickness, the first yarn comprising a fine count yarn that is a synthetic fiber spun yarn or a filament yarn with a weight not higher than 27.8 g/km, and the second yarn is a thick count yarn that is a pure cotton yarn or a blended yarn with pure cotton and other fibers with a weight not less than 18.2 g/km, and the twist factor of the thick count yarn is not higher than 295; and warping a ground warp yarn and the composite low-twist yarn that serves as a low-twist pile warp yarn; and weaving on a towel loom or a warp loom using the ground warp yarn, the composite low-twist yarn and a weft yarn to form the low-twist yarn product;

wherein the step of forming the terry yarn comprises the steps of:

spinning the fine-count yarn with a twist direction of the spun fine-count yarn being in a first direction;

spinning the thick count yarn with a twist direction of the spun thick count yarn being the first direction;

combining the spun fine count yarn and the spun thick count yarn on a doubling machine to form a combined yarn; and twisting the combined yarn in a second direction that is opposite to the first direction to form the twisted combined yarn that comprises the terry yarn;

winding the twisted combined yarn and preparing the twisted combined yarn for dyeing or warping;

wherein the sliver twist from the false twist device to the output roller and from the false twist device and a wire ring of the spinning frame is substantially increased, a spinning triangle is eliminated, a speed of false twist device is separately controlled by a servo motor, wherein a sliver output from the front roller forms an included angle through the false twist device, showing arc-shaped contact; setting a specific linear speed ratio for the output linear speed of the false twist device and the front roller between 1.2-1.5.

19. The method according to claim 14, wherein the step of spinning the thick count includes the following step: changing a cotton assorting of the thick count yarn to improve the strength and hairiness of the thick count yarn.

20. The method according to claim 19, wherein the step of changing the cotton assorting comprises the step of selecting long staple cotton or mixing a synthetic fiber into cotton.

21. The method according to claim 12, wherein the synthetic fiber is a fiber selected from the group consisting of: terylene fiber, nylon fiber and regenerated cellulose fiber.

22. A method of producing a composite low-twist yarn towel, comprising the steps of:

(i) using a spinning device to spin a fine-count yarn that comprises a synthetic staple fiber or a regenerated cellulose fiber or mixtures thereof, wherein a weight of the spun fine-count yarn is not more than 27.8 g/km, and a twisting direction of the spun fine-count yarn is not fixed;

(ii) spinning a thick-count yarn using the spinning device to conduct opening, removing impurities, combing and drawing to a cotton fiber or a mixed fiber of cotton and other fibers to form a thick yarn sliver, wherein a weight of spun thick-count yarn is not less than 18.2 g/km, and the twist factor of the spun thick yarn spun is not higher than 295; and wherein a twist direction of the spun thick-count yarn is the same twist direction as the spun fine-count yarn of step (i);

(iii) combining the spun fine-count and spun thick-count yarns formed in steps (i) and (ii) on a doubling machine;

(iv) twisting the combined yarn of step (iii) in an opposite twist direction as that of the thick-count yarn and fine-count yarn spun in steps (i) and (ii) to form a terry yarn, wherein a number of twists of the composite low-twist yarn is no higher than 30 per decimeter;

(v) conduct winding for the yarns made in step (iv), and prepare for dyeing or warping; and (vi) weaving on a towel loom or a warp loom the ground warp yarn, the terry yarn and a weft yarn to form the composite low-twist yarn towel.

* * * * *